US012616262B2

(12) United States Patent
Hua

(10) Patent No.: US 12,616,262 B2
(45) Date of Patent: May 5, 2026

(54) WIG AND WEARING METHOD THEREOF

(71) Applicant: XUCHANG LONGQI ELECTRONIC COMMERCE CO., LTD., Xuchang City (CN)

(72) Inventor: Yunlong Hua, Yuzhou City (CN)

(73) Assignee: Xuchang Longqi Electronic Commerce Co., Ltd., Xuchang (CN)

( * ) Notice: Subject to any disclaimer, the term of this patent is extended or adjusted under 35 U.S.C. 154(b) by 198 days.

(21) Appl. No.: 18/436,538

(22) Filed: Feb. 8, 2024

(65) Prior Publication Data

US 2025/0255373 A1 Aug. 14, 2025

(51) Int. Cl.
*A41G 3/00* (2006.01)

(52) U.S. Cl.
CPC ..... *A41G 3/0025* (2013.01); *A41G 3/0016* (2013.01); *A41G 3/0033* (2013.01)

(58) Field of Classification Search
CPC .. A41G 3/0008; A41G 3/0016; A41G 3/0025; A41G 3/0033; A41G 3/005
See application file for complete search history.

(56) References Cited

U.S. PATENT DOCUMENTS

2011/0023902 A1* 2/2011 Cho ..... A41G 3/005 132/53
2016/0227863 A1* 8/2016 Nakajima ..... A41G 3/0016
2019/0059486 A1* 2/2019 Kim ..... A41G 3/005

* cited by examiner

*Primary Examiner* — Rachel R Steitz

(57) ABSTRACT

A wig includes a front end and a rear end. A lower end of the front end forms an edge part, and adhesive strips are provided on both sides of the front end. An elastic strap is provided at a lower end of the rear end. A first adjusting structure is provided on a surface of the elastic strap. The first adjusting structure includes: a first band, one end of which is connected to one end of the elastic strap and the other end of the first band is provided with a first hook; a second band, one end of which is connected to the other end of the elastic strap and the other end of the second band is provided with a second hook; and a first socket, provided in the middle of the elastic strap. The first hook and the second hook are plugged in the first socket.

16 Claims, 2 Drawing Sheets

WIG AND WEARING METHOD THEREOF

TECHNICAL FIELD

The present disclosure relates to the field of wigs, and particularly to a wig and a wearing method thereof.

BACKGROUND

Wigs are made of synthetic fibers and are usually worn on wearer's head to be used as a decoration and make the user look better. To ensure a fixed wearing of a wig, current wigs need to be fixed to the wearer's head by means of a large amount of adhesive, which means the wigs cannot be easily removed, so that the wearer has to keep their hair unwashed for a long time, which may cause problems such as an itchy scalp. Additionally, when a wearer is trying to remove a wig from his/her head, it may be difficult for the wearer to take off the wig due to the presence of adhesive, and the skin of the wearer may be even hurt if the wearer tries to remove it too hard, which means a risk of unsafety. Furthermore, current wigs cannot be adjusted according to a shape of a head of a wearer, and thus the wig may fit the head of the wearer much worse and it is inconvenience for the wearer to use it.

SUMMARY

In view of the above, the disclosure provides a wig and a wearing method thereof, in order to solve at least one of the following technical problems: avoiding using a large amount of adhesive for a wig, achieving adjustability of a wig's size, and being matchable with various hairlines.

The objective of the disclosure is mainly achieved by the following technical solutions:

In a first aspect of the present disclosure, the disclosure provides a wig, which includes a front end and a rear end. A lower end of the front end forms an edge part, and adhesive strips are provided on both sides of the front end. An elastic strap is provided at a lower end of the rear end, and a first adjusting means is provided on a surface of the elastic strap. The first adjusting means includes: a first band, one end of the first band is connected to one end of the elastic strap and the other end of the first band is provided with a first hook; a second band, one end of the second band is connected to the other end of the elastic strap and the other end of the second band is provided with a second hook; and a first socket, provided in middle of the elastic strap. The first hook and the second hook are plugged into the first socket.

In some embodiments, a number of the first sockets is more than one.

In some embodiments, one end of the first hook is provided with a first backbending hook, a length of the first backbending hook is one-quarter to one-half of a vertical length of the first hook.

In some embodiments, one end of the second hook is provided with a second backbending hook, a length of the second backbending hook is one-quarter to one-half of a vertical length of the second hook.

In some embodiments, the first adjusting means further includes a first looping part, which is connected to the elastic strap, and the first band passes through the first looping part.

In some embodiments, the first adjusting means further includes a second looping part, which is connected to the elastic strap, and the second band passes through the second looping part.

In some embodiments, an antiskid strip is provided below the first adjusting means.

In some embodiments, an elastic comb is provided above the elastic strap, and the teeth of the elastic comb faces upwards.

In some embodiments, a second adjusting means is provided above the elastic strap, the second adjusting means includes: a second socket provided on both sides of the rear end; and a third band, a third hook is provided on both ends of the third band, the third hook is plugged into the second socket.

In some embodiments, the third band is provided with an adjusting buckle.

In some embodiments, a surface of the third band is provided with an antiskid rubber strip.

In some embodiments, the third hook is provided with a third backbending hook, the length of third backbending hook is one-quarter to one-half of a vertical length of the third hook.

In some embodiments, the front end and the rear end are made of hexagonal mesh material.

In some embodiments, the third hook is provided with more than one protrusions.

In some embodiments, a length of the adhesive strip is 4-5 cm and a width of the adhesive strip is 1-2 cm.

In a second aspect of the present disclosure, the disclosure provides a wearing method of the wig, including the following steps: S1: wearing the wig on the wearer's head by using a front end, a rear end, an elastic strap, and a first adjusting means; S2: adjusting a position of the wig so that an edge part clings to a hairline of the wearer's head; and S3: attaching an adhesive strip to a wearer's face.

In some embodiments, the step S1 includes: S11: sleeving the front end onto a front of the wearer's head so that the front end clings to the front of the wearer's head; S12: Stretching the elastic strap and sleeving the rear end onto the back of the wearer's head so that the rear end clings to the back of the wearer's head; and S13: adjusting the first adjusting means to further secure the wig on the wearer's head.

In some embodiments, the step S2 includes: S21: moving the wig to align the edge part with the hairline of the wearer's head; S22: pulling the wig towards the head to attach the edge part to the hairline of the hairline of the wearer's head; S23: adjusting a second adjusting means so that the edge part clings to the hairline of the wearer's head; and S24: inserting an elastic comb into a hair on the back side of the wearer's head.

Compared with the prior art, the disclosure may at least achieve one of the following beneficial effects:

The wig provided by the disclosure may be adjusted in size according to the shape of the wearer's head with adhesive strips provided only on both sides of the front end in cooperation with the first adjusting means. The technical problem that wigs in the prior art has to use a large amount of adhesive may be solved and the wig may be easily worn and removed, and the wearer may feel more comfortable in wearing the wig and it is more convenient for the wearer to use the wig.

B) The wig provided by the disclosure may fit heads in various shapes and has a wider range of applications by using the second adjusting means in cooperation with the first adjusting means to adjust the size of the wig.

BRIEF DESCRIPTION OF THE DRAWINGS

The drawings forming a part of the present disclosure are for the purpose of providing further understanding of the present disclosure, and so that the features, objectives, and advantages thereof may be more clearly apparent. The schematic embodiment drawings of the present disclosure and their descriptions are configured to explain the present disclosure and do not constitute an improper limitation on the present disclosure. In the drawings.

REFERENCE NUMBERS

Figure 1:
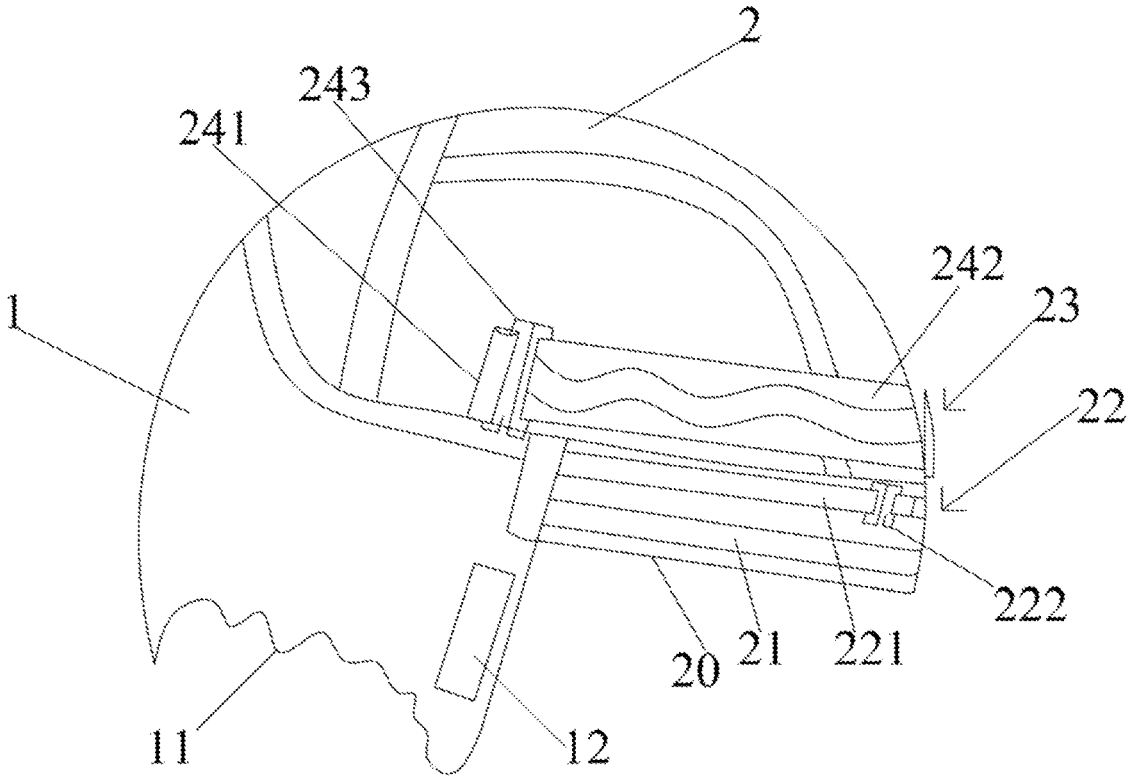
FIG. 1 is a right side view of the wig provided by the disclosure.

1: front end, 11: edge part, 12: adhesive strip, 2: rear end, 20: elastic strap, 21: antiskid strip, 22: first adjusting means, 221: first band, 222: first hook, 2221: first backbending hook, 223: second band, 224: second hook, 2241: second backbending hook, 225: first socket, 226: first looping part, 227: second looping part, 23: elastic comb, 231: teeth, 24: second adjusting means, 241: second socket, 242: third band, 243: third hook, 244: adjusting buckle, 2421: antiskid rubber strip, 2431: third backbending hook, 2432: protrusion.

DETAILED DESCRIPTION

In the following description, for the purposes of explanation, numerous specific details are set forth in order to provide a thorough understanding of various exemplary embodiments or implementations of the disclosure. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. Further, various exemplary embodiments may be different, but do not have to be exclusive. For example, specific shapes, configurations, and characteristics of an exemplary embodiment may be used or implemented in another exemplary embodiment without departing from the inventive concepts.

When an element, is referred to as being "on," "connected to," or "coupled to" another element, it may be directly on, connected to, or coupled to the other element or intervening elements may be present. When, however, an element is referred to as being "directly on," "directly connected to," or "directly coupled to" another element or layer, there are no intervening elements or layers present. To this end, the term "connected" may refer to physical, electrical, and/or fluid connection, with or without intervening elements.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein should be interpreted accordingly.

The terminology used herein is for the purpose of describing particular embodiments and is not intended to be limiting. As used herein, the singular forms, "a," "an," and "the" are intended to include the plural form meanings as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

It is important to understand that the FIGS. of the disclosure show inside of a wig without hairpiece fixed therein, to illustrate various components and connections therebetween.

Figure 2:
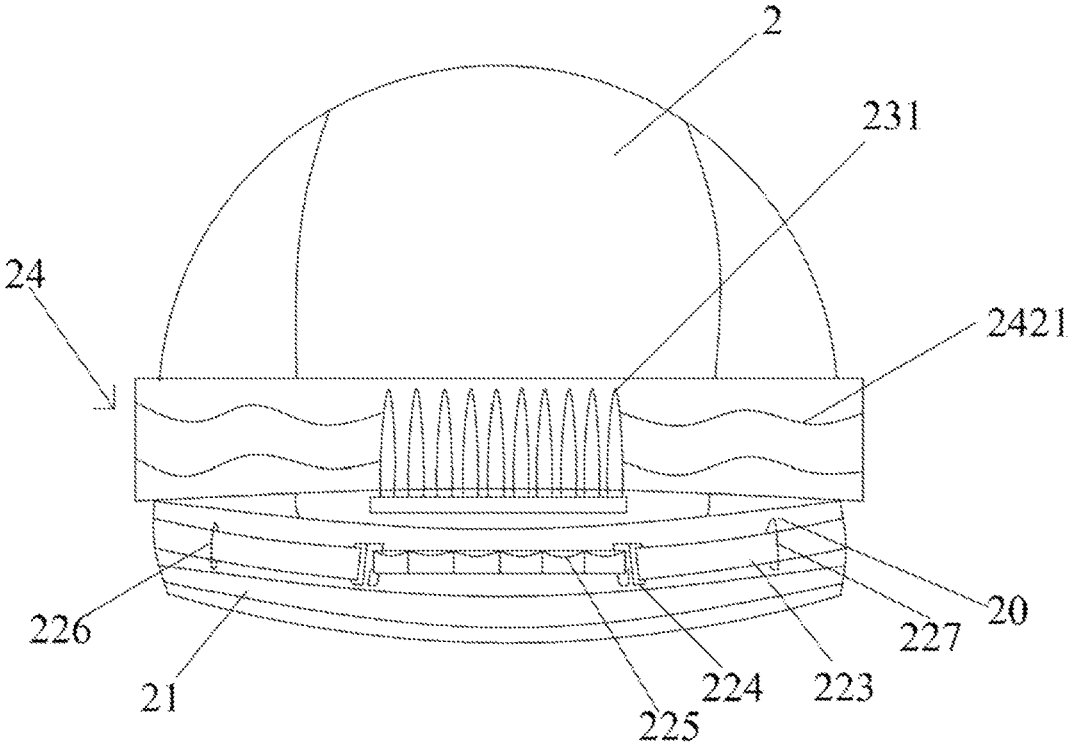
FIG. 2 is a rear view of the wig provided by the disclosure.
Figure 3:
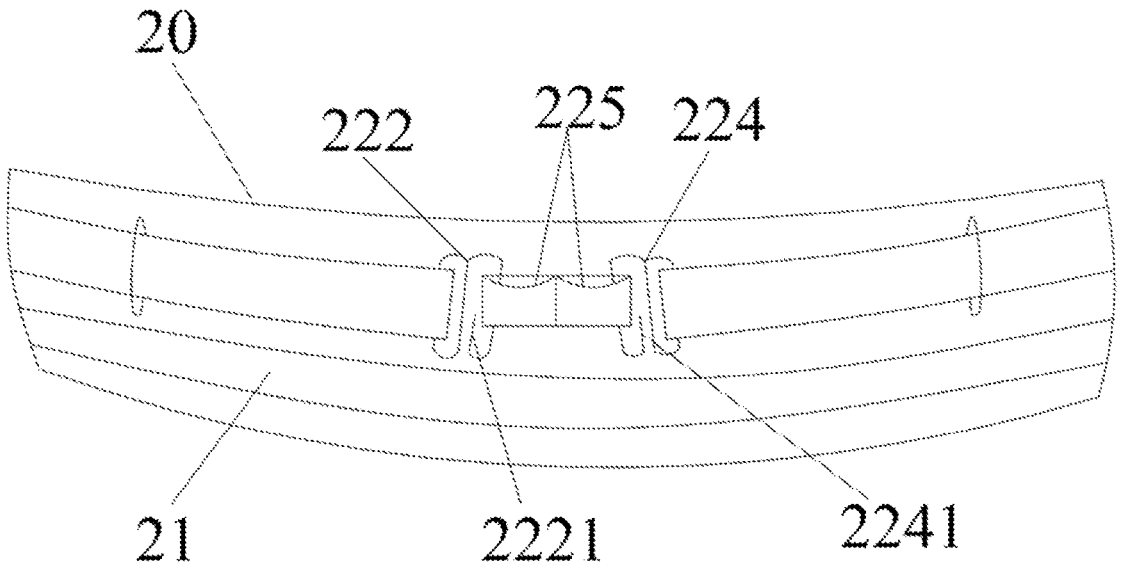
FIG. 3 is a schematic structural view of the elastic strap, the first adjusting means, and the antiskid strip of the wig provided by the disclosure.
Figure 4:
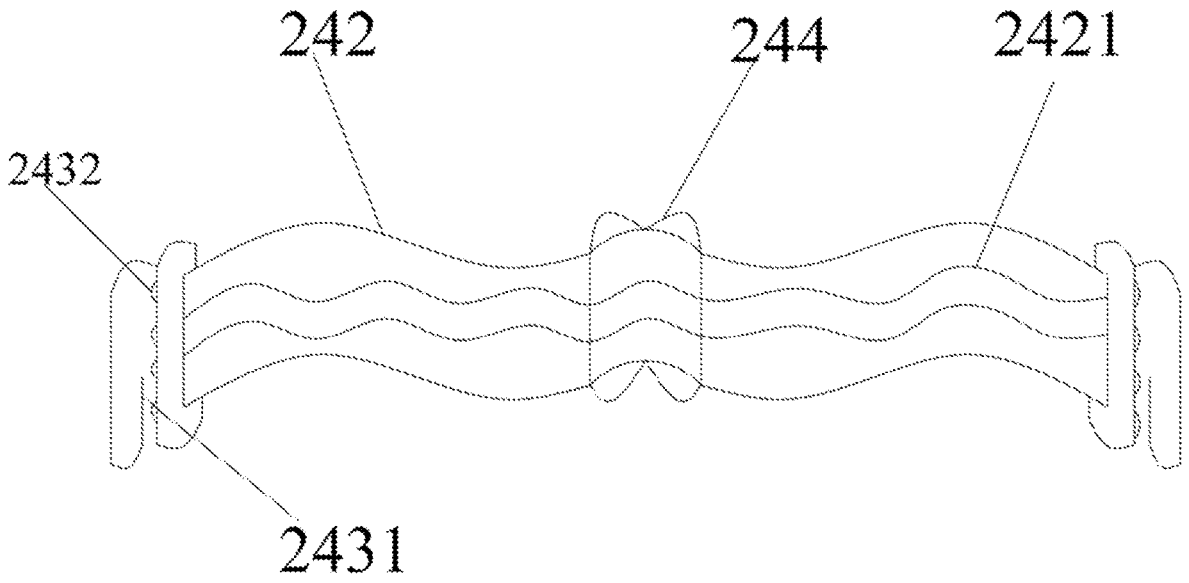
FIG. 4 is a schematic structural view of the third band of the wig provided by the disclosure.

In the first aspect, with reference to FIGS. 1-4, the disclosure provides a wig, which includes a front end 1 and a rear end 2. The front end 1 is configured to be sleeved onto front of the wearer's head, and the rear end 2 is configured to be sleeved onto back of the wearer's head. Both the front end 1 and the rear end 2 are made of a hexagonal mesh material that may secure hairpiece. A lower end of the front end 1 forms an edge part 11, which is wavy in shape to align with the hairline of the wearer's head, so as to make the wig unnoticeable.

In some embodiments, adhesive strips 12 may be provided on both sides of the front end 1, and may be sticked to the wearer's face to fix the wig. When a wearer wears the wig, such adhesive strips 12 may be located in an area from the temples to front of the ears of the wearers. In some cases, a length of the adhesive strip 12 may be 4-5 cm, preferably 4.5 cm, and a width may be 1-2 cm, preferably 1.2 cm. In some cases, when the wearer removes the wig, the wearer may remove the used adhesive strips 12 from the front end, and a new adhesive strip may be attached when the wig is used again later, or adhesive strip 12 may be configured to be reusable.

In some embodiments, a lower end of the rear end 2 is provided with an elastic strap 20. The elastic strap 20 may be used to securely fix the wig onto the wearer's head in cooperation with the front end 1 and the rear end 2. In some cases, the elastic strap 20 may further include a surface made of elastic hexagonal mesh material, which may be used to fix the wig. In some cases, the surface of the elastic strap 20 may be provided with a first adjusting means 22. The first adjusting means 22 may include: a first band 221, one end of which is connected to one end of the elastic strap 20, and the other end is provided with a first hook 222; a second band 223, one end of which is connected to the other end of the elastic strap 20, and the other end is provided with a second hook 224; a first socket 225, which is provided in the middle of the elastic strap 20. The first hook 222 and the second hook 224 may be pluggable into a first socket 225. In some cases, the first band 221 and the second band 223 may be an elastic strap.

In order for the wig to be adjustable to be adaptive to various shapes of heads, more than one of the said first sockets 225 may be provided so that the wearer may choose which first socket 225 for the first hook 222 or the second hook 224 to be plugged into according to the size of the wearer's head. In some cases, the first hook 222 and the second hook 224 may be made of plastic or metal.

When a wearer wears the wig provided by the disclosure, the wearer may sleeve the front end 1 onto the front of the wearer's head and sleeve the rear end 2 onto the back of the wearer's head, adjust the plugging of the first hook 222 or the second hook 224 into the first socket 225 according to the shape of the wearer's head, so as to wear the wig on the wearer's head. Furthermore, the wearer may move the position of the wig, to align the edge part 11 with the wearer's hairline to make the wig unnoticeable. Then, the adhesive strips 12 may be attached to the wearer's face to further fix the wig.

With the wig provided by the present disclosure, the technical problem that wigs in the prior art has to use a large amount of adhesive may be solved and the wig may be easily worn and removed, and the wearer may feel more comfortable in wearing the wig and it is more convenient for the wearer to use the wig.

In some embodiments, one end of the first hook 222 may be provided with a first backbending hook 2221 to further prevent the first hook 222 from coming out of the first socket 225. In some cases, the length of the first backbending hook 2221 may be in a range of one-quarter to one-half of the vertical length of the first hook 222. In some embodiments, the first adjusting means 22 may further include a first looping part 226. The first looping part 226 may be connected to the elastic strap 20. The first band 221 may pass through the first looping part 226 to further stabilize the first band 221.

In some embodiments, one end of the second hook 224 may be provided with a second backbending hook 2241 to further prevent the second hook 224 from coming out of the first socket 225. The length of the second backbending hook 2241 may be in a range of one-quarter to one-half of the vertical length of the second hook 224. In some embodiments, the first adjusting means 22 may further include a second looping part 227. The second looping part 227 may be connected to the elastic strap 20. The second band 223 may pass through the second looping part 227 to further stabilize the second band 223.

In some embodiments, a antiskid strip 21 may be provided below the first adjusting means 22 and contact the wearer's head to prevent the sliding therebetween. The antiskid strip 21 may be made of silicone. In some cases, the antiskid strip 21 may be fixedly provided on a surface of the elastic strap 20.

In some embodiments, an elastic comb 23 may be provided above the elastic strap 20, and has teeth 231 facing upwards to be further fixed to the wearer's hair. It should be noted that the elastic comb 23 may be bendable forwards and backwards so that the wig may be easily worn and removed.

In some embodiments, a second adjusting means 24 may be provided above the elastic strap 20. The second adjusting means 24 may include: a second socket 241, which is provided on both sides of the rear end 2; a third band 242, provided with third hooks 243 on both sides thereof. The third hooks 243 may be pluggable into the second socket 241 to allow the third band 242 to be around the rear end 2. In some cases, the third band 242 may be provided above the connection of the elastic comb 23 and the rear end 2. The third band 242 may be located inside the teeth 231 of the elastic comb 23.

In some embodiments, the third band 242 may be an elastic strap and may have an adjusting buckle 244. The adjusting buckle 244 may be configured to adjust the length of the third band 242. In some cases, the surface of the third band 242 may be further provided with an antiskid rubber strip 2421, which may be made of silicone.

In some embodiments, the third hook 243 may be provided with a third backbending hook 2431 to further prevent the third hook 243 from coming out of the second socket 241. In some cases, the length of the third backbending hook 2431 may be in range of one-quarter to one-half of the vertical length of the third hook 243.

In some embodiments, the third hook 243 may have a plurality of protrusions 2432 to further increase friction with the second socket 241 to prevent the third hook 243 from coming out. In some cases, the third hook 243 may be made of plastic or metal materials.

It should be noted that although explanation is made with the third hook 243 inserted into the second socket 241 while facing downwards as an example in FIGS. Of the present disclosure, the disclosure is not limited to such configuration. The third hook 243 may be alternatively inserted into the second socket 241 while facing upwards.

It should be noted that that a wearer may adjust the size of the wig by using only the first adjusting means 22 without utilizing the third band 242. When the wearer needs further adjustment on the size of the wig, the wearer may use both the first adjusting means 22 and the third band 242 so as for the wig to fit the wearer's head better.

In some embodiments, the front end 1 may be a lace mesh surface, and the color of the lace mesh surface may be white, flesh color, transparent, and so on, to better achieve an "invisible" effect in wearing. In some cases, the lace mesh surface may undergo a thermal pressing process to form a "curved surface" that fits a shape of the front of the wearer's head. Furthermore, because the lace mesh surface is in a curved shape, an edge of the lower end of the lace mesh surface may bend inward to form an edge part. When the wearer wears the wig, the curved shape of the lace mesh surface may cling to the front of the wearer's head, and the inwardly curved edge part may better wrap around the front of the wearer's head so that the stability of wearing may be improved.

In producing of the wig of the present disclosure, the lace mesh surface may be pre-cut according to various heights of hairlines to form an edge part 11 that fits various heights of hairline. When a wearer wears the wig, it is unnecessary for the wearer to cut it additionally. It is simple to operate and convenient for the wearer to use. Preferably, the lace mesh surface of the disclosure may be cut by using an electrical heating scissor during cutting. During the cutting process, the heat generated by the electrical heating scissor may effectively seal the edges of the cut lace mesh surface to improve the durability of the lace mesh surface.

In some embodiments, the aspect ratio of the front end 11 is (13:1) to (13:6), preferably 13:4. The lace mesh surface has expanded a range of the edge part 11, so that the lace mesh surface may cover the temples of the wearer's head, and the range of the hairline that the wearer may present may be increased so as to fit various hair styles and be a delicate solution.

In some embodiments, the hexagonal mesh material of the front end 1 and rear end 2 of the wig may be provided with antibacterial properties, so as to effectively inhibit the odors that may generate by the wig being worn for long time.

The second aspect of the disclosure provides a wearing method of the wig, which includes the following steps:

S1: wearing the wig on the wearer's head by using a front end 1, a rear end 2, an elastic strap 20, and a first adjusting means 22;

S2: adjusting a position of the wig so that an edge part 11 clings to a hairline of the wearer's head; and S3: attaching an adhesive strip 12 to the wearer's face.

With the wearing method described above, the wearer may easily fix the wig on the head without using a large amount of adhesive and it is necessary for the wearer to cut the front end 1. The wearer may just adjust the position of the wig so that the edge part 11 may cling to the hairline of the wearer's head. The wearer may adjust the size of the wig according to the shape of his/her head and it is convenient for the wearer to wear the wig.

In some embodiments, the step S1 may further include:

S11: sleeving the front end 1 onto a front of the wearer's head so that the front end 1 clings to the front of the wearer's head;

S12: stretching the elastic strap 20 and sleeving the rear end 2 onto the back of the wearer's head so that the rear end 2 clings to the back of the wearer's head; and S13: adjusting the first adjusting means 22 to further fix the wig on the wearer's head.

It should be noted that, the step S11 and the step S12 may be exchanged in sequence. With the steps described above, the front end 1 and the rear end 2 may cling to the front and back of the wearer's head by means of the elastic strap 20, and the first adjusting means 22 may be further adjusted to further improve the stability in wearing the wig.

Furthermore, the step S2 may further include:

S21: moving the wig to align the edge part 11 with the hairline of the wearer's head;

S22: pulling the wig towards the head so that the edge part 11 clings to the hairline of the hairline of the wearer's head;

S23: adjusting a second adjusting means 24 so that the edge part 11 clings to the hairline of the wearer's head; and S24: inserting an elastic comb into a hair on the back side of the wearer's head.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

The invention claimed is:

1. A wig, comprising a front end and a rear end, wherein, a lower end of the front end forms an edge part, and adhesive strips are provided on both sides of the front end;

an elastic strap is provided at a lower end of the rear end, and a first adjusting assembly is provided on a surface of the elastic strap, the first adjusting assembly comprises:

a first band, one end of which is connected to one end of the elastic strap and an other end of the first band is provided with a first hook;

a second band, one end of which is connected to the other end of the elastic strap and the other end of the second band is provided with a second hook; and first sockets, provided in a middle of the elastic strap, wherein the first hook and the second hook are plugged in the first sockets, wherein a second adjusting assembly is provided above the elastic strap, the second adjusting assembly comprises:

second sockets, provided on both sides of the rear end; and a third band, wherein a third hook is provided on both ends of the third band, the third hook is plugged in the second socket.

2. The wig according to claim 1, wherein a number of the first sockets is more than one.

3. The wig according to claim 1, wherein one end of the first hook is provided with a first backbending hook, a length of the first backbending hook is in a range of one-quarter to one-half of a vertical length of the first hook.

4. The wig according to claim 1, wherein one end of the second hook is provided with a second backbending hook, a length of the second backbending hook is in a range of one-quarter to one-half of a vertical length of the second hook.

5. The wig according to claim 1, wherein the first adjusting assembly further comprises a first looping part, which is connected to the elastic strap, and the first band passes through the first looping part.

6. The wig according to claim 1, wherein the first adjusting assembly further comprises a second looping part, which is connected to the elastic strap, and the second band passes through the second looping part.

7. The wig according to claim 1, wherein an antiskid strip is provided below the first adjusting assembly.

8. The wig according to claim 1, wherein an elastic comb is provided above the elastic strap, and teeth of the elastic comb faces upwards.

9. The wig according to claim 1, wherein the third band is provided with an adjusting buckle.

10. The wig according to claim 1, wherein a surface of the third band is provided with an antiskid rubber strip.

11. The wig according to claim 1, wherein the third hook is provided with a third backbending hook, a length of third backbending hook is in a range of one-quarter to one-half of a vertical length of the third hook.

12. The wig according to claim 1, wherein the front end and the rear end are made of hexagonal mesh material.

13. The wig according to claim 1, wherein the third hook is provided with more than one protrusions.

14. The wig according to claim 1, wherein a length of the adhesive strip is 4-5 cm and a width of the adhesive strip is 1-2 cm.

15. A wearing method of the wig according to claim 1, comprising the following steps:

S1: wearing the wig on a wearer's head by using the front end, the rear end, the elastic strap, and the first adjusting assembly;

S2: adjusting a position of the wig so that the edge part clings to a hairline of the wearer's head; and S3: attaching the adhesive strips to a wearer's face, wherein the step S2 comprises:

S21: moving the wig to align the edge part with the hairline of the wearer's head;

S22: pulling the wig towards the head to attach the edge part to the hairline of the hairline of the wearer's head:

S23: adjusting a second adjusting assembly so that the edge part clings to the hairline of the wearer's head; and S24: inserting an elastic comb into a hair on a back side of the wearer's head.

16. The wearing method according to claim 15, wherein the step S1 comprises:

S11: sleeving the front end onto a front of the wearer's head so that the front end clings to the front of the wearer's head;

S12: stretching the elastic strap and sleeving the rear end onto the back of the wearer's head, so that the rear end clings to the back of the wearer's head; and S13: adjusting the first adjusting assembly to further secure the wig on the wearer's head.

* * * * *